United States Patent [19]

Stroh

[11] 3,956,805

[45] May 18, 1976

[54] STRAP CLIP

[75] Inventor: Maria E. Stroh, Astoria, N.Y.

[73] Assignee: Lawrence Peska Associates, Inc., New York, N.Y. ; a part interest

[22] Filed: June 16, 1975

[21] Appl. No.: 587,347

[52] U.S. Cl. ..... 24/259 R; 24/73 LF

[51] Int. Cl.[2] ..... A44B 21/00

[58] Field of Search ..... 24/73 LF, 259 A, 262 GC, 24/248 BB; 2/2

[56] References Cited

UNITED STATES PATENTS

| | | | |
|---|---|---|---|
| 668,391 | 2/1901 | Ritter | 24/259 |
| 1,486,153 | 3/1924 | Milligan | 24/73 LF |
| 1,593,783 | 7/1926 | Adams | 24/73 LF |
| 1,594,051 | 7/1926 | DeMos | 24/73 LF |

*Primary Examiner*—Paul R. Gilliam
*Assistant Examiner*—Doris L. Troutman

[57] ABSTRACT

This disclosure pertains to clips fastened to garments which clasp straps or cords of shoulder bags, cameras and the like. The function of the clip is to preclude the strap or carrying cord from slipping off the shoulder of the user and to prevent theft. The outermost surface of the clip can be decoratively finished.

5 Claims, 4 Drawing Figures

STRAP CLIP

BACKGROUND OF THE DISCLOSURE

1. The Field of the Invention

This invention relates to garment chips and more particularly clips used to retain straps, handles or cords affixed to devices carried by slinging over the shoulder of the user.

2. Description of the Prior Art

Strap clips have been devised to retain straps in the general area of the shoulder of the user. A typical construction is shown in U.S. Pat. No. 2,792,607 issued to A. J. H. Packham, May 21, 1957. The strap is fully confined by the described structure when the clip is closed. Difficulty is encountered, however, when the clip is manipulated into the closed or open position as only one hand of the user can effectively be used due to the usual mounting position on the shoulder.

SUMMARY OF THE INVENTION

An outer garment clip functionally confining a segment of a strap, cord or other flexible handle attached to handbags, cameras and the like, structured for simple attachment to the outer surface of the garment, most generally in the shoulder area of the user. The clip can be opened with one hand and closed by inserting the strap into a cavity. Simple manipulation of the strap or the clip causes the cavity to move into a position that confines the strap effectively and lock the elements comprising the cavity into a locked position. The outermost element of the cavity can be decoratively finished or prepared to permit broaches to be fastened to it so as to conceal the clips' functional parts.

A primary object of the invention is to provide a garment clip for fastening straps that can be simply closed by manipulation of either the strap or the clip.

Another object is to provide a clip which has two states of rest, proscribed by a spring, biasing the retaining cavity into either the open strap receiving position or the closed strap retaining position.

Still another object is to provide a surface which can be decorated or adorned with an additional broach and pin combination.

DESCRIPTION OF THE PREFERRED EMBODIMENTS

The structure and method of fabrication of the present invention is applicable to a garment clip complete with a cavity used to receive and confine straps or cords. The cavity is a biased structure pivotably fastened to a base plate which is fastened to the garment of the user. The cavity is comprised of two parallel elements fastened at one end by a plate transverse to them. The transverse plate is pivoted and fastened to a leg vertically attached to the base plate. Opposite to the leg and parallel to it is another leg complete with a lip for engagement with one cavity element when the cavity is locked, completes the totally closed cavity capturing a strap or cord. The biasing spring means aids the closing of the cavity in one state of rest. In the other state of rest the U shaped cavity formed by the parallel elements and the transverse plate is biased into the open position.

Figure 1:
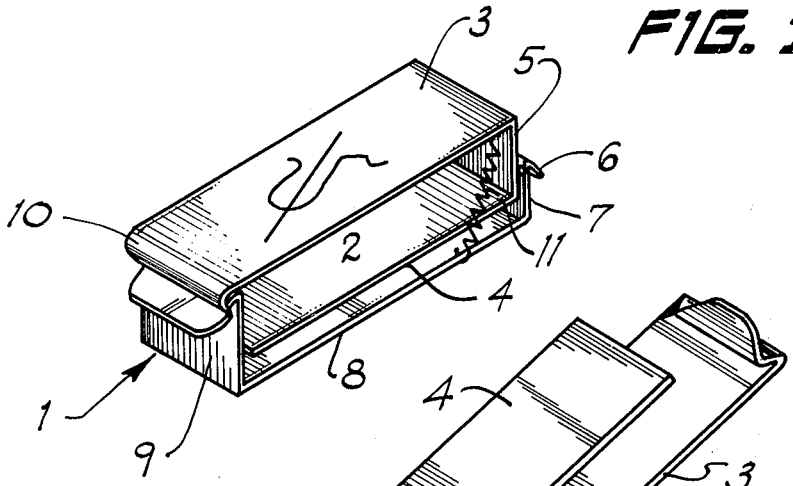
FIG. 1 is an isometric view of the clip in the closed position.

Now referring to the figures and more particularly to the embodiment illustrated in FIG. 1 which depicts the clip 1 in the closed position. A cavity is formed by parallel elements 3 and 4 joined at one end by a transverse plate 5. Pivot 6 fastens plate 6 to a vertical leg 7 of a base section 8. On the side opposite the vertical leg 7 another vertical leg 9, parallel to the leg 7 and vertical to 8, is adapted with a locking tab for engagement with the closing catch 10. Spring 11 is fastened to the base section 8 and the intersection of the parallel element 3 and the transverse plate 5. The compression spring 11 biases the transverse cover element such that the cavity 2 is closed by the vertical leg 9.

Figure 2:
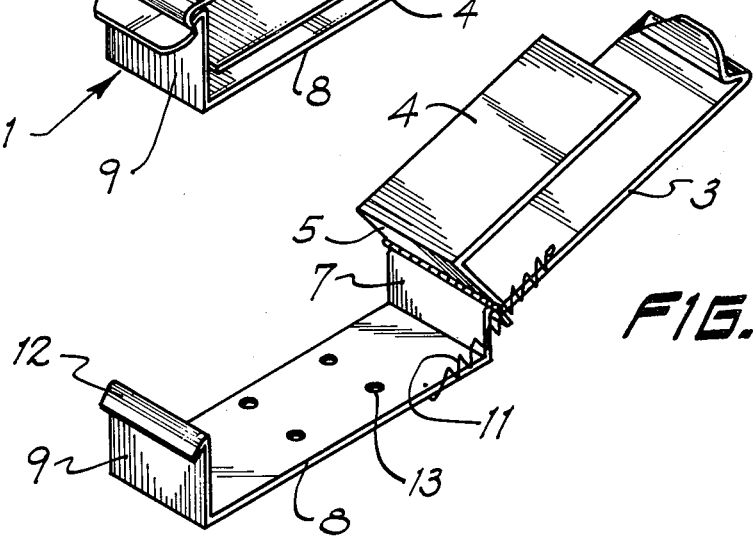
FIG. 2 is an isometric view of the clip in the open position.

FIG. 2 show the clip in the open position. Spring 11 keeps cavity elements 3, 4 and 5 biased pivotally open and away from base supporting elements 7, 8 and 9. Locking tab 12, formed at the upper free end of vertical leg 9 is used to engage catch 10 when the cavity is closed. Holes 13 may be used to sew or otherwise fasten the clip to an outer garment depicted fragmentally by 14 in FIG. 3.

Figure 3:
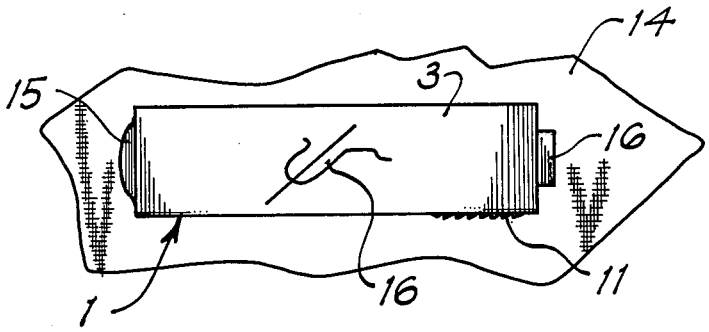
FIG. 3 is a plan view of the clip and a segment of the garment to which it is attached.

FIG. 3 illustrates the clip 1 fastened to a segment 14 of the outer garment of the user. The free end of cavity element 3 is bent to form catch 10 and terminates in release tab 15. The free end of the vertical leg 7 is bent almost back on itself to form the stopping tab 16 which prevents the cavity when in the open position from being forced to lie on the garment when biased into the open position by the spring 11, thus permitting ease of insertion of a strap or cord, not shown.

Figure 4:
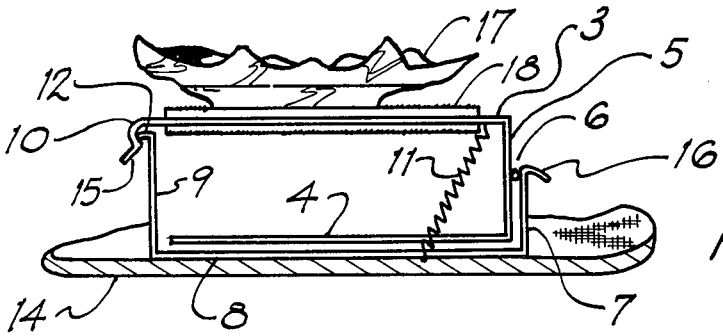
FIG. 4 is an elevation view of the clip including a decorative broach attached.

FIG. 4 shows a broach and pin combination 17 pinned to a fabric sleeve 18 encasing cavity cover element 3. Sleeve 18 may be removed or installed by slipping action over the bent over closing catch 10 and release tab 15. When sleeve 18 is removed the decorative design 16 shown in FIG. 3 serves to make the appearance of the clip more attractive.

Compression spring 11 is shorter in length either in the fully closed or fully open position as compared to a mid-open position. Thus the force exerted by the spring performs a toggle action keeping the cavity formed either fully closed or open. A moderate twisting force exerted by the strap inserted into the cavity overcomes the bias force of the spring keeping the cavity open so as to close the cavity and engage the catching mechanism. The user thus can use one arm to simply close the cavity and completely capture the strap. By similar action, but in the reverse direction, one hand can be used to free the catch by an upward pull on the release catch and a twisting motion on the strap thus forcing the cavity to fully open and remain open while the strap is being removed. Should a cord like element, similar to cords attached to cameras and small tape recording devices be used, hand manipulation of the cavity replaces the twisting motion imparted to the cavity when a flat strap is used instead of a cord. The action of the spring simplifies the strap or cord insertion and removal process in either case.

One of the advantages is accomplished by the ease of opening or closing of the clip by manipulation of the strap or the clip itself. Inserting the strap properly causes the clip to almost automatically close itself.

Another advantage is provided by the clip having two stable conditions of rest. When open the strap can be easily inserted. When closed, the same biasing means tends to keep the clip closed.

Still another advantage lies in the decorative effect created by an additional decorative device fastened to the uppermost surface of the clip or in a design fashioned in the cover element of the clip.

Thus, there is disclosed in the above description and in the drawings embodiments of the invention which fully and effectively accomplish the objects thereof. However, it will be apparent to those skilled in the art how to make variations and modifications to the instant invention. Therefore, this invention is to be limited not by the specific disclosure herein, but only by the appending claims.

The embodiments of the invention in which an exclusive privilege or property is claimed are defined as follows.

I claim:

1. A strap clip comprised of a cover plate having a generally rectangular shape, one end of said plane bent to form a catch and releasing tab means, the other end of said cover plate bent vertically downwards to a pivot point, said vertically bent section continuing to a point at which a bend forms a leg parallel to said cover plate forming generally a U shaped section, said leg shorter in length than said cover plate, a base section of generally rectangular cross section bent to have two arms parallel to each other, one of the said arms terminated in a transverse lip, the other of said arms having a pivot point at the intersection of said arm and a tab bent from said arm at the free end thereof, a spring fastened to the cover plate at the end opposed from said catch and releasing tab means and to said base section at a point intermediate said arms, pivot means fastened to said vertically bent section intermediate said cover plate and said parallel leg, said pivot means fastened to said pivot point, said tab in locking engagement with said catch and releasing tab when said leg is parallel to said base.

2. The strap clip of claim 1, further comprising a design fashioned into the outermost surface of said cover plate.

3. The strap clip of claim 1 in combination with a fabric sleeve capturing substantially the entire length of said cover plate.

4. The strap clip of claim 3 further comprising a combination of a combination broach and pin fastened to said sleeve.

5. The strap clip of claim 1 further comprised of holes in said base section, said holes adapted to fasten said base section to the garment of a user.

* * * * *